US007151514B2

(12) United States Patent
Chen et al.

(10) Patent No.: US 7,151,514 B2
(45) Date of Patent: Dec. 19, 2006

(54) METHOD FOR HANDLING A SIGNAL AND THE APPLICATION THEREOF

(75) Inventors: Li-Yi Chen, Nantou (TW); Lin-Kai Bu, Tainan (TW)

(73) Assignee: Chi Mei Optoelectronics Corp., Tainan County (TW)

( * ) Notice: Subject to any disclaimer, the term of this patent is extended or adjusted under 35 U.S.C. 154(b) by 195 days.

(21) Appl. No.: 10/127,490

(22) Filed: Apr. 23, 2002

(65) Prior Publication Data

US 2003/0030605 A1 Feb. 13, 2003

(30) Foreign Application Priority Data

Jul. 25, 2001 (TW) ..... 90118242 A

(51) Int. Cl.
*G09G 3/36* (2006.01)

(52) U.S. Cl. ..... 345/87; 345/89; 345/101; 345/204; 345/690; 345/691

(58) Field of Classification Search ..... 345/87, 345/88, 92–100, 204, 690, 691, 89, 101
See application file for complete search history.

(56) References Cited

U.S. PATENT DOCUMENTS 5,457,474 A * 10/1995 Ikeda ..... 345/92
6,078,421 A * 6/2000 Davey et al. ..... 359/237
6,115,423 A * 9/2000 Shen et al. ..... 375/240.03
6,177,914 B1 * 1/2001 Iwama et al. ..... 345/60
6,320,562 B1 * 11/2001 Ueno et al. ..... 345/87
6,480,230 B1 * 11/2002 Honma ..... 348/443
6,661,401 B1 * 12/2003 Sekine ..... 345/92
2001/0035850 A1 * 11/2001 Okamoto et al. ..... 345/77
2001/0040546 A1 * 11/2001 Ohmuro et al.
2002/0024481 A1 * 2/2002 Kawabe et al.

* cited by examiner

*Primary Examiner*—Richard Hjerpe
*Assistant Examiner*—Jennifer T. Nguyen
(74) *Attorney, Agent, or Firm*—Dickinson Wright PLLC

(57) ABSTRACT

A method for handling a signal and the application thereof, and more particularly relates to a method for handling a display signal of hold-type display and the application thereof. The handling method of the present invention is that a digital process is performed to the display signal according to the operational surrounding data of hold-type display in order to obtain the compensative signal of the display signal. Then, a compiling process is performed with the compensative signal and the display signal in order to obtain a compensated display signal. Therefore, the response time of the hold-type display and the motion blur during displaying will be improved so that the display quality which is suitable for human eyes will be obtained.

22 Claims, 10 Drawing Sheets pulse-type display hole-type display

METHOD FOR HANDLING A SIGNAL AND THE APPLICATION THEREOF

FIELD OF THE INVENTION

The present invention relates to a method for handling a signal and an application thereof, and more particularly relates to a method for applying a digital signal processing module will a function of inverse function process in a hold-type display of handling a display signal. Therefore, the response time of the hold-type display and the motion blur during display will be improved, so that the display quality suitable for human eyes will be obtained.

BACKGROUND OF THE INVENTION

In the development of the hold-type display, such as a liquid crystal display (LCD) organic light emitting diode (OLED), because of the advantages of low power consumption, easy installation, and good future development, the hold-type display has been widely used in technical fields and is popular among consumers. Therefore, the development of the hold-type display will move toward more complete electrical characteristics of a wider display area and better display quality, etc.

However, the display quality of hold-type displays is worse than that of cathode ray tubes (CRTs), because there is a difference between the display theorem of hold-type displays and that of CRTs.

Generally, the display theorem of a CRT is that the input electronic display signal is transformed into an enhanced electron beam and then restored to image by deflective scanning and screen. In other words, the contrast, color, gray level of display image will be obtained according to a scan with the electron beam. Referring to FIG. 1, FIG. 1 is a diagram depicting a brightness signal vs. time for a conventional CRT display, wherein the brightness signal 10 is a continuous time-dependent pulse. Referring to FIG. 2, FIG. 2 is a spectrum diagram showing the brightness signal processed by Fourier Transformation for a conventional CRT display according to FIG. 1. As shown in FIG. 2, when the amplitude signal 12 is maintained stably within the cutoff frequency 14 or continuously at a horizontal status, the blurring of a moving image is not visible, since it is not sensitive for human eyes to receive the display image whose frequency is over the cutoff frequency 14 (generally about 60 Hz).

On the other hand, the display theorem of a hold-type display, such as an LCD, is different from the display theorem of a CRT. The display theorem of an LCD is to twist the liquid crystal by bias to block light, or to let light go through, because the liquid crystal of an LCD cannot emit light by itself. Then the light will pass through the color filter to have different colors. Referring to FIG. 3, FIG. 3 is the diagram depicting a brightness signal vs. time for a conventional LCD, wherein the brightness signal 10 is a continuous time-dependent curve. Referring to FIG. 4, FIG. 4 is a spectrum diagram showing the brightness signal processed by Fourier Transformation for a conventional LCD according to FIG. 3. When the amplitude signal 22 cannot be maintained stably within the cutoff frequency 24, and declines at the cutoff frequency 24 as shown in FIG. 4, human eyes will sense a blurred image apparently, especially for a motion image, because human eyes are sensitive to the image whose frequency is within the cutoff frequency 24.

Referring to FIG. 5, FIG. 5 is another diagram depicting a brightness signal vs. time for a conventional LCD. The brightness signal 26 as shown in FIG. 5 is affected due to the slow rotation of LC molecules. FIG. 6 is a spectrum diagram showing the brightness signal processed by Fourier Transformation for a conventional LCD according to FIG. 5. The amplitude signal 28 as shown in FIG. 6 will decline quickly at the cutoff frequency 30, because the brightness signal 26 of FIG. 5 is affected by the parasitic capacitance, RC delay etc. Therefore, the image will be more obscure.

Referring to FIG. 7, FIG. 7 is a diagram of display time vs. display position for a conventional impulse-type display, and meanwhile, referring to FIG. 8, FIG. 8 is a diagram of display time vs. display position for a conventional hold-type display. Because the liquid crystal of an LCD acts like "a switch of light" for controlling the transmittivity of light, there will be a time delay between "open" and "close" of "the switch of light" because of the slow response of the liquid crystal. Thus, there will be a residual image in the display, and the contrast will decrease.

In FIG. 7 and FIG. 8, the path of display character of pulse-type display is almost continuous, and the path of display character of hold-type display is like a stair. By further comparing FIG. 1, FIG. 2 and FIG. 3, FIG. 4, after the display signal is processed by Fourier Transformation, the amplitude of display signal of pulse-type display is maintained horizontally and stably in accordance with frequency, and the amplitude of display signal of hold-type display is a continuous wave depending on frequency, although the same signal is displayed. Thus, the image quality of hold-type display is worse than the image quality of pulse-type display, because there are blurring image in hold-type display in high frequency within the time domain.

Referring to FIG. 9, FIG. 9 is a diagram showing the comparison between the transmissivity of an LCD and the brightness property of a CRT. In FIG. 9, the curve of the brightness property of a CRT rises gradually. In other words, any brightness and gray level are controlled by a continuous voltage. However, regardless of the normal black display mode and the normal white display mode, the curve of the transmissivity of an LCD is like an "S". There is the threshold voltage 50 in the normal black display mode, and there is the threshold voltage 60 in the normal white display mode. When the control voltage achieves the threshold voltage, the change of transmissivity will begin. In FIG. 9, it is shown that the action of a liquid crystal of an LCD is like "a switch of light", because the light will pass if the "switch" opens, and the light will be blocked if the "switch" closes.

Referring to FIG. 10, FIG. 10 is a flow sheet of the conventional image process. First, a display signal 70 is provided and will be transformed to a digital signal 74 at a signal receiver 72 after an amplification process, a filter process and a sampling process. Then the digital signal 74 is transferred to a display signal adjuster 76 for image compensation and adjustment, and the optimum display signal will thus be obtained. Afterwards, a driving signal 80 transformed from the optimum display signal by utilizing a decoder and driver 78 will be outputted to a monitor 82, so that human eyes 84 can see the image of the display signal 70.

Recently LCD is used widely in all respects, but the dynamic display quality of an LCD is worse than the dynamic display quality of a CRT. In order to enhance the dynamic display quality of a hold-type display, such as an LCD and an OLED, many methods are applied. For example, a compensation or correcting module is added to enhance the dynamic display quality or to speed up the response time of the liquid crystal in a conventional image process.

However, a lot of improved methods are aimed at the static V-T (voltage-time) curve of an LCD, and the interactive relation between the dynamic response between liquid crystal of an LCD and human eyes is ignored. The driving process of liquid crystal of an LCD consists of a series of fast action in the liquid crystal, so that the response of the liquid crystal is dynamic in different surroundings, such as different temperature, different humidity etc. Therefore, the efficacy of the conventional method for improving the dynamic display quality is limited. The dynamic display quality can only be improved slightly by speeding up the response speed of the liquid crystal of an LCD, and there is still a limitation to the response speed of the liquid crystal. Besides, the cost and difficulty of implementation is higher, so that the cost of the product will increase.

SUMMARY OF THE INVENTION

In the view of the background of the invention described above, the image and motion blur will appear in displaying a dynamic image, especially displaying a dynamic image in high frequency because of the display theorem of a hold-type monitor. It is one object of the present invention to provide a method for handling a signal. In the present invention the digital signal process will be performed with the display signal and the parameters collected from the display system to obtain the inverse function of the display signal for compensating the display signal properly. Therefore the response time, dynamic display quality, contrast, gray level etc. of the hold-type monitor, especially of an LCD, will be improved.

It is another object of the present invention to provide an application of the method for handling a signal. In the present invention, the image quality of LCD, especially the dynamic display quality in high frequency, will be improved to achieve the optimization for human eyes by utilizing the method of the present invention. In the present invention, the collection of system parameters and compensative process of the display signal are based on the vision of human eyes in order to achieve the optimization for human eyes.

In accordance with the aforementioned purpose of the present invention, the present invention provides a method for handling a signal and the application thereof. In the method of the present invention, the operating function of an inverse function used in a digital signal process module will be implemented on the driving technique of a monitor, especially on a hold-type display. The process in the digital signal process module of the present invention is based on the display signal and the parameters collected from a display system. After the display signal is processed by the digital signal process module of the present invention, an inverse function operator will be obtained and used as a complement signal for the display signal. Then the compiling process will be performed with the display signal and the complement signal to obtain a compensated display signal for improving the display quality. Therefore, both dynamic and static display will have the image with high quality, thereby achieving the optimization for human eyes. Moreover, the present invention can be implemented with low cost and does not need to change the original display system a lot.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
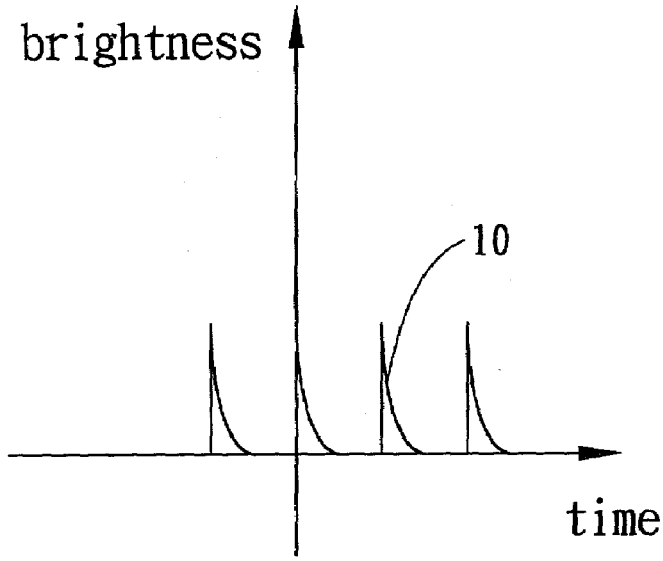
FIG. 1 (PRIOR ART)
FIG. 1 is a diagram showing the curves of brightness signal vs. time for a conventional CRT display.
Figure 2:
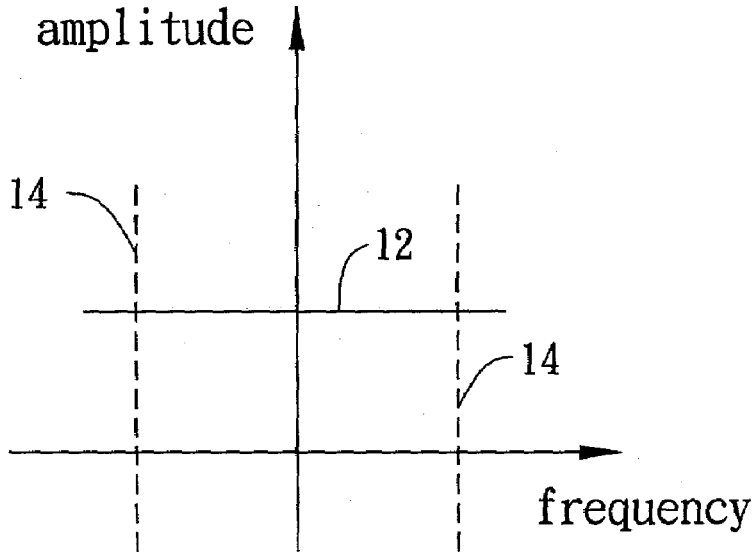
FIG. 2 (PRIOR ART)
FIG. 2 is a spectrum diagram showing the brightness signal processed by Fourier Transformation for a conventional CRT display according to FIG. 1.
Figure 3:
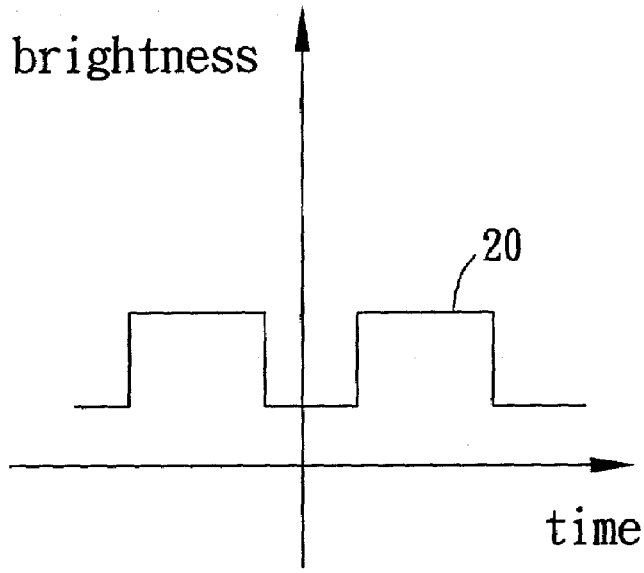
FIG. 3 (PRIOR ART)
FIG. 3 is a diagram depicting a brightness signal vs. time for a conventional LCD.
Figure 4:
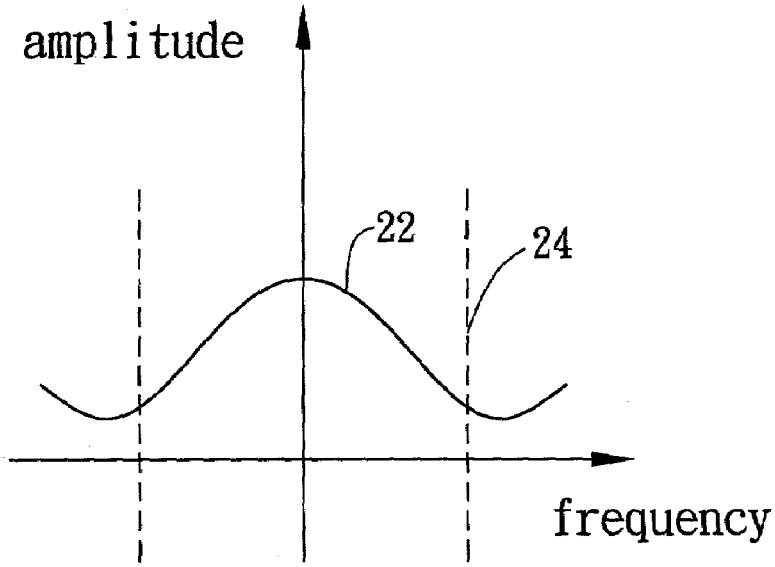
FIG. 4 (PRIOR ART)
FIG. 4 is a spectrum diagram showing the brightness signal processed by Fourier Transformation for a conventional LCD according to FIG. 3.
Figure 5:
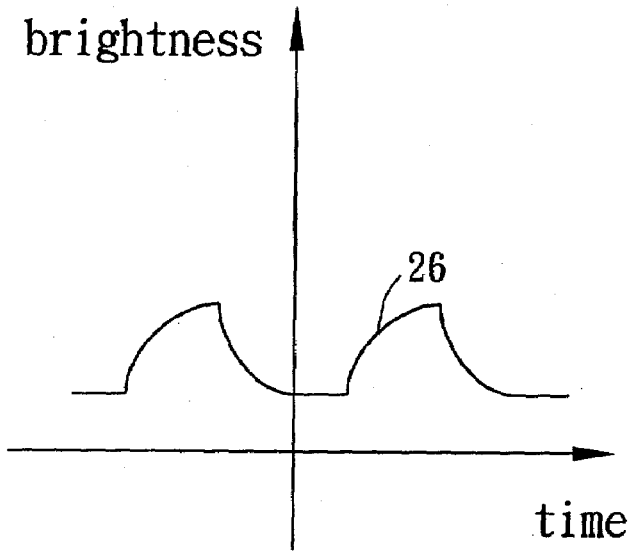
FIG. 5 (PRIOR ART)
FIG. 5 is another diagram showing the curve of brightness signal vs. time for a conventional LCD.
Figure 6:
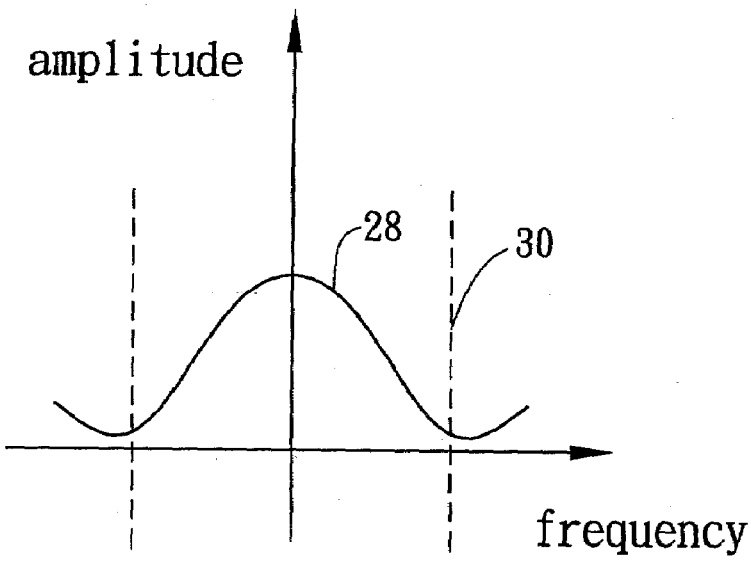
FIG. 6 (PRIOR ART)
FIG. 6 is a spectrum diagram showing the brightness signal processed by Fourier Transformation for a conventional LCD according to FIG. 5.
Figure 7:
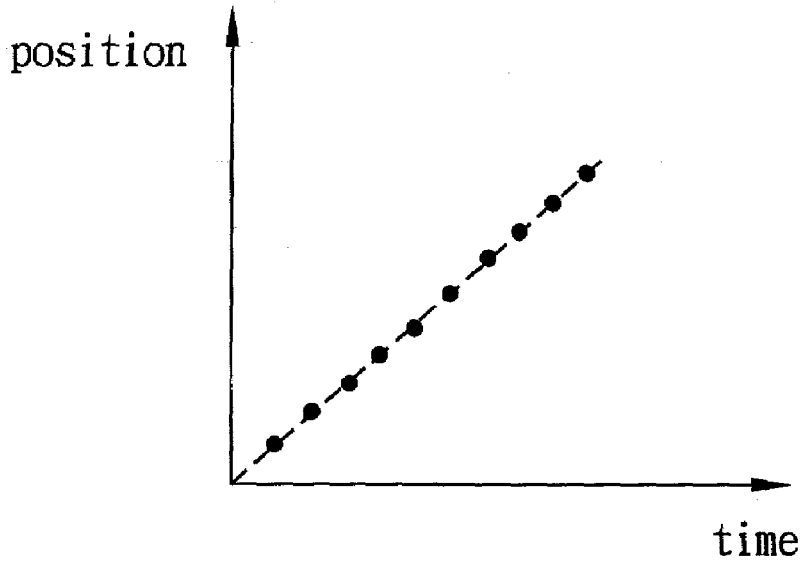
FIG. 7 (PRIOR ART)
FIG. 7 is a diagram of display time vs. display position for a conventional impulse-type display.
Figure 8:
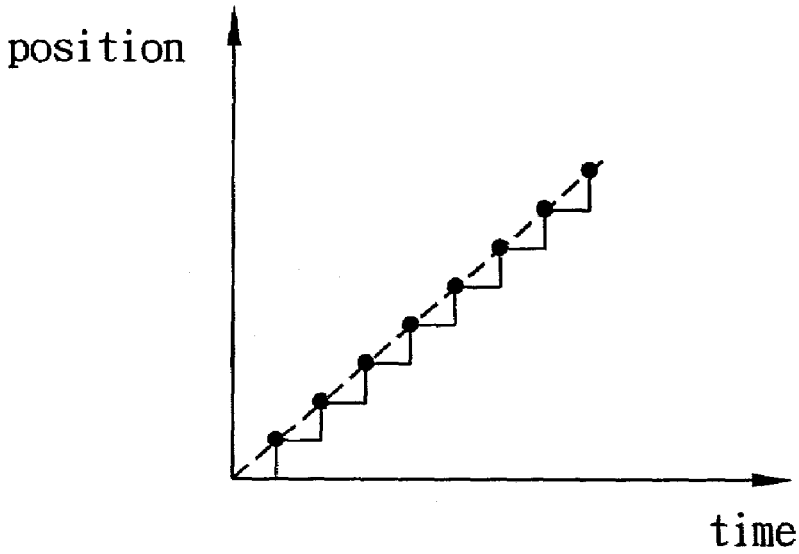
FIG. 8 (PRIOR ART)
FIG. 8 is a diagram of display time vs. display position for a conventional hold-type display.
Figure 9:
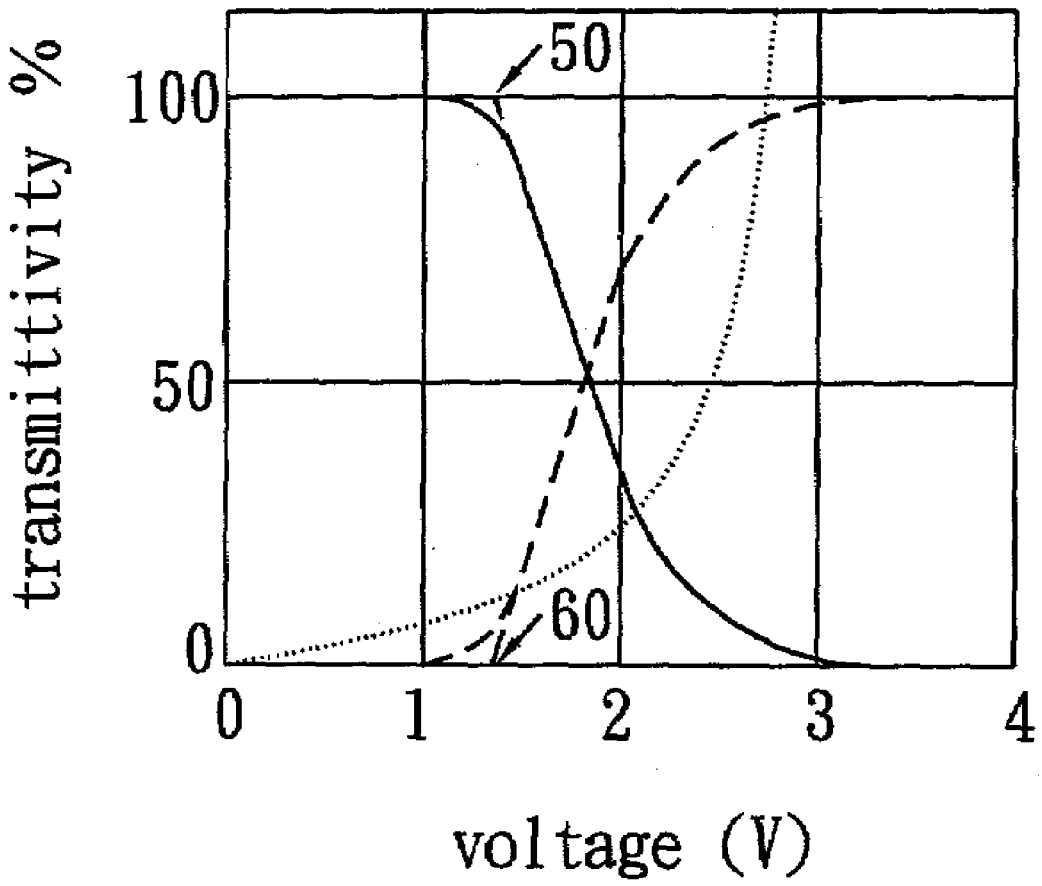
FIG. 9 (PRIOR ART)
FIG. 9 is a diagram showing the comparison between the transmittivity of LCD and the brightness property of CRT.
Figure 10:
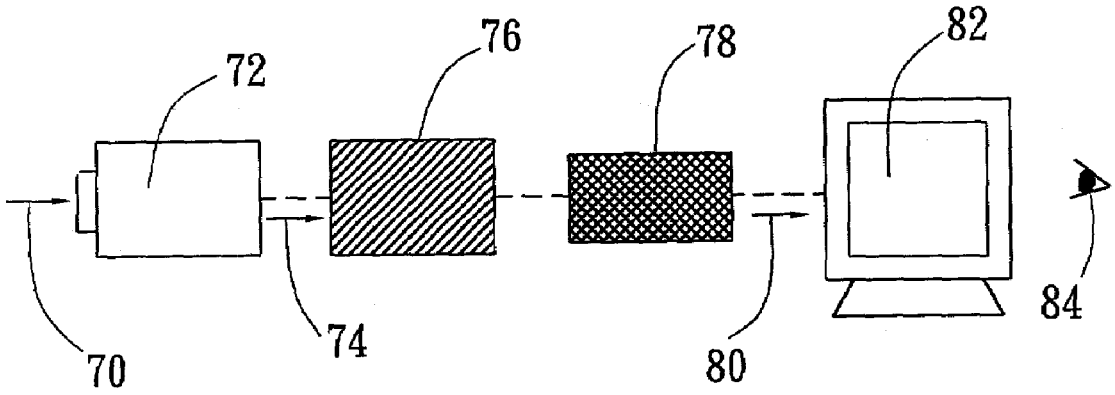
FIG. 10 (PRIOR ART)
FIG. 10 is a flow sheet of the conventional image process.

Referring to FIG. 2 and FIG. 4, in order to enhance the high-frequency dynamic display quality of a hold-type display, an amplitude signal 22 shown in FIG. 4 is maintained stably within a cutoff frequency 24 such as the amplitude signal 22 shown in FIG. 2, and will not decay from the cutoff frequency 24. A digital signal process module will be inserted for handling the display signal in the image handling process by utilizing the method provided by the present invention for handling the signal.

Figure 11:
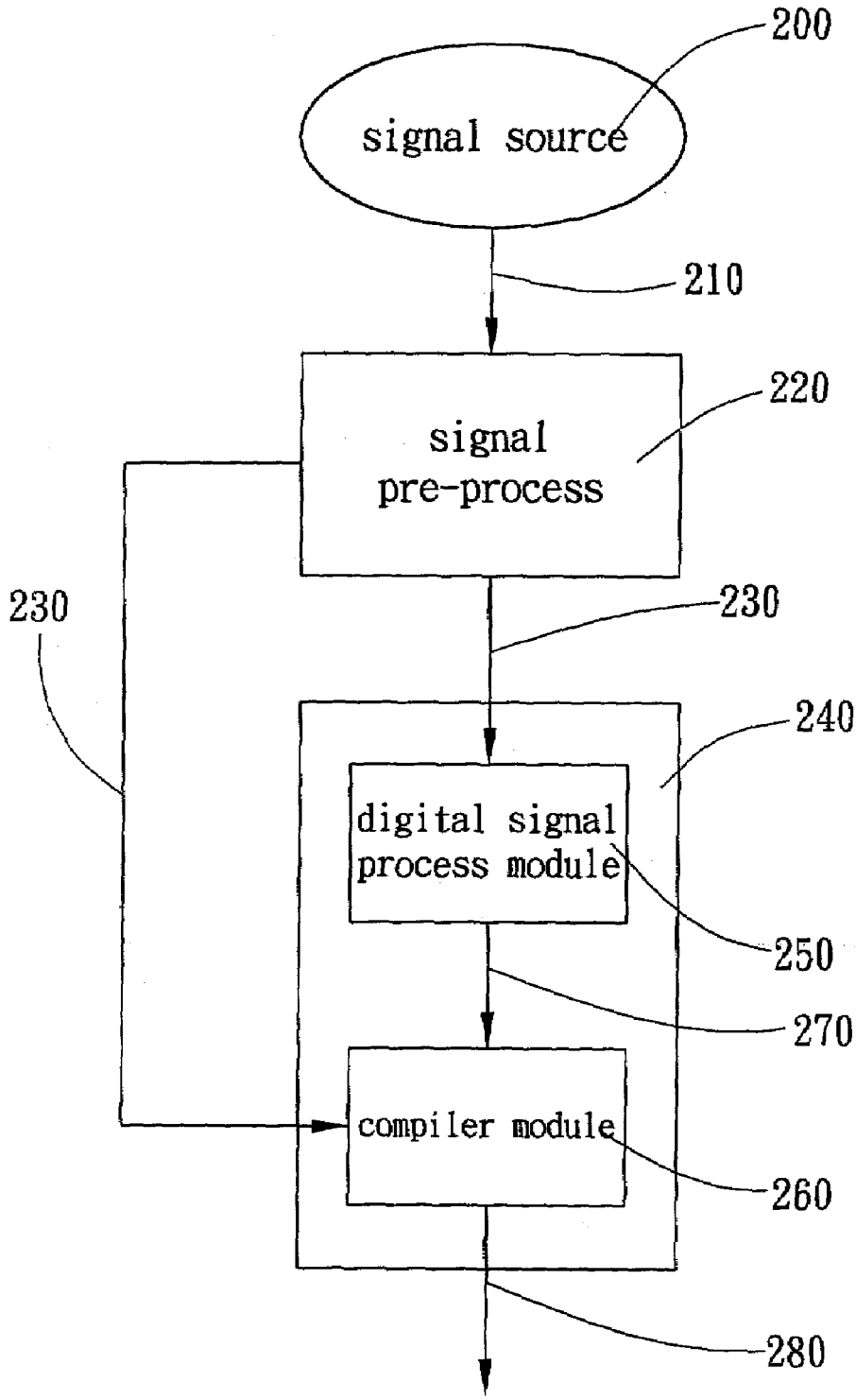
FIG. 11 is an operational flow chart of an embodiment of the present invention.

Referring to FIG. 11, FIG. 11 is an operational flow chart of an embodiment of the present invention. A display signal 210 that can be any valid wave is produced from a signal source 200. The display signal 210 will be transferred to an initial digital display signal 230 by amplifying, filtering, sampling and other processes in the signal pre-process 220. Then the initial digital display signal 230 enters a signal process module 240 which consists of a digital signal process module 250 and compiler module 260. When the initial digital display signal 230 enters the signal process module 240, the surrounding temperature, work temperature, visual angle, clock time, frequency, work voltage and other system parameters will be collected by the digital signal process module 250 from the display system (not shown) and the operational surroundings. Then, according to the differential of the display signal versus time or space, and the relational data obtained by performing a look-up table with the collected system parameters, a digital signal process, such as an inverse function operation, will be performed with the initial digital display signal 230 in order to obtain a compensative signal 270 of the initial digital display signal 230. Afterward, an initial digital display signal 230 and the compensative signal 270 of the initial digital display signal 230 enter the compiler module 260 for a compiling process. After the compiling process, a digital display signal 280 will be generated. The digital display signal 280 is compensated and adjusted by the compensative signal 270, so that the digital display signal 280 will be a wave, such as the horizontal wave shown in FIG. 2. Hence, the display quality of the digital display signal 280 will be clearer than the display quality of the initial digital display signal 230.

The operation of an inverse function described above, is based on a mathematical theorem, which is a complementary property between a signal and an inverse function of the signal and where the result of compensating the signal by the inverse function is one. By using the mathematical theorem, the initial display signal is compensated by the inverse function of the initial display signal in the driving technique of a hold-type display. Therefore, the quality of the initial display signal will be improved, and the motion blur will decrease during dynamic display in a high frequency because the weakness of the initial display signal can be compensated by the inverse function of the initial display signal.

Figure 12:
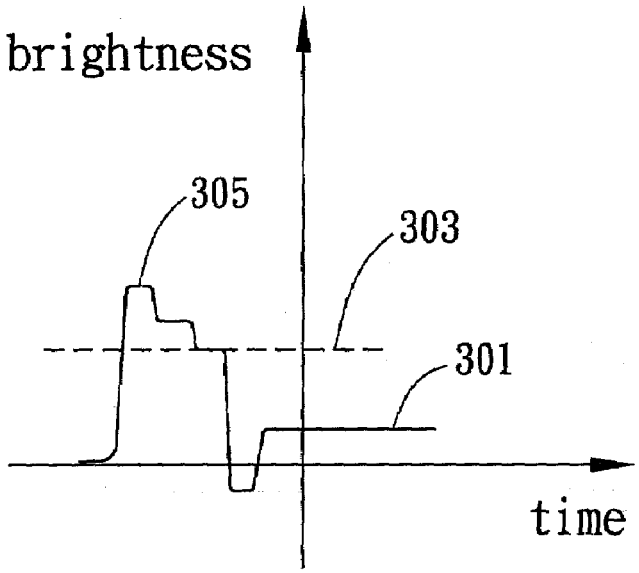
FIG. 12 is a diagram showing the curve of brightness signal vs. time by utilizing an embodiment of the present invention in the driving technique of LCD.
Figure 13:
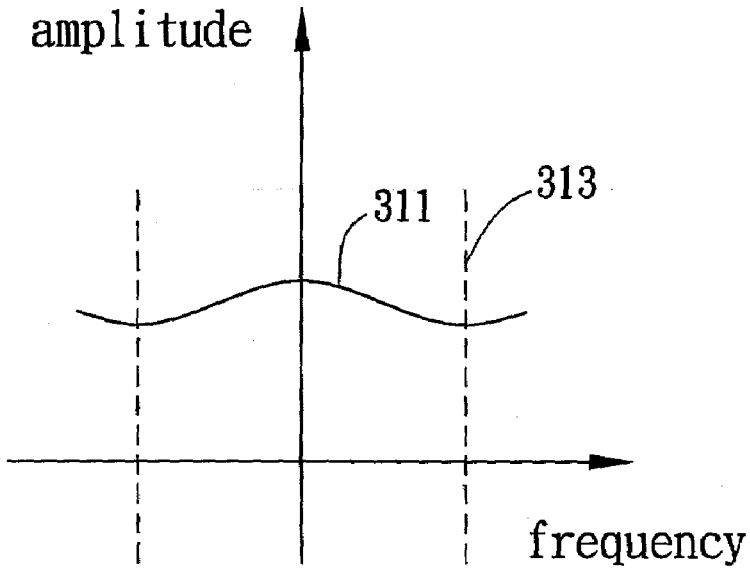
FIG. 13 is a spectrum diagram showing the brightness signal processed by Fourier Transformation by utilizing an embodiment of the present invention in the driving technique of LCD.

Referring to FIG. 12, FIG. 12 is a diagram showing the curve of a brightness signal vs. time by utilizing an embodiment of the present invention in the driving technique of an LCD, wherein the brightness signal 301 is first brought up to a high level 305 that is over the target level of brightness and then adjusted several times to the target level of brightness. Referring to FIG. 13, FIG. 13 is a spectrum diagram showing the brightness signal processed by Fourier Transformation by utilizing an embodiment of the present invention in the driving technique of an LCD. By comparing FIG. 4 and FIG. 13, the trend of an amplitude signal 311 approaches the horizontal within a cutoff frequency 313 by utilizing an embodiment of the present invention in the driving technique of an LCD. In other words, the decline of the amplitude signal 311 is smaller than the one not using the embodiment of the present invention, and will not decay as the frequency increases, so that the high-frequency dynamic display quality of a hold-type display will be enhanced.

Figure 14:
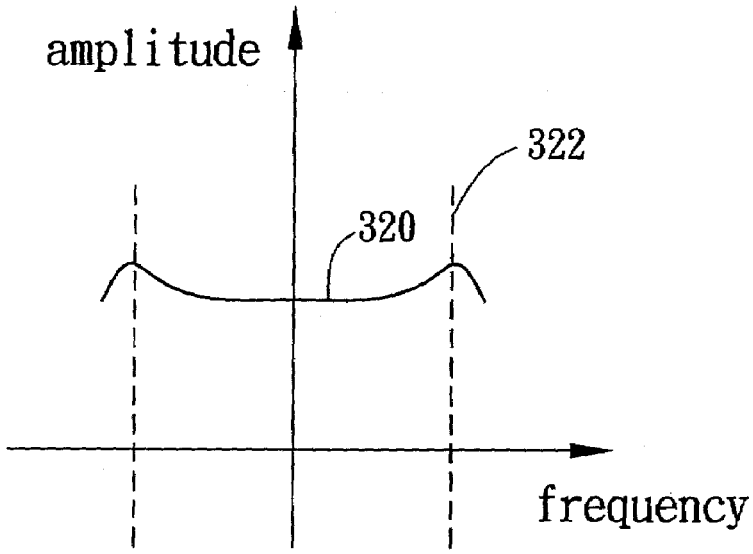
FIG. 14 is a spectrum diagram showing the brightness signal processed by Fourier Transformation by utilizing another embodiment of the present invention in the driving technique of LCD.

Referring to FIG. 14, FIG. 14 is a spectrum diagram showing the brightness signal processed by Fourier Transformation by utilizing another embodiment of the present invention in the driving technique of LCD. By utilizing another embodiment of the present invention in the driving technique of LCD, an amplitude signal 320 obtained by processing the brightness signal with Fourier Transformation will have a higher amplitude than a traditional amplitude signal at the cutoff frequency 322, when the parameters calculated in the digital signal process of the present invention are adjusted properly. Therefore, by adjusting the parameters calculated by the digital signal process of the present invention properly, the display signal can be a pre-determined wave in the frequency band, and meet the demand by an easy adjustment through the signal handling method of the present invention.

Figure 15:
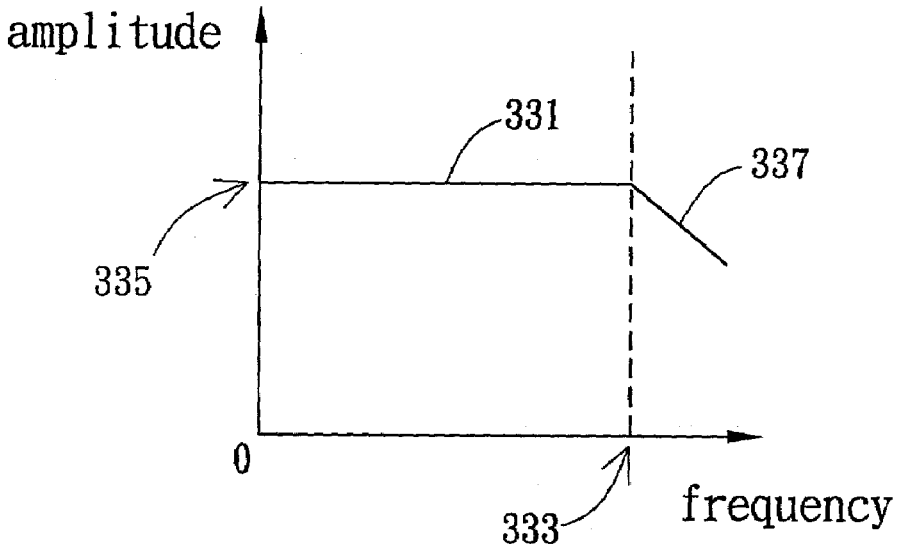
FIG. 15 is a spectrum diagram showing the brightness signal processed by Fourier Transformation by utilizing another embodiment of the present invention in the driving technique of LCD.

Moreover, referring to FIG. 15, FIG. 15 is a spectrum diagram showing the brightness signal processed by Fourier Transformation by utilizing another embodiment of the present invention in the driving technique of an LCD. According to FIG. 15, by utilizing another embodiment of the present invention, after the brightness signal is processed by Fourier Transformation, the wave of the amplitude signal 311 will be the same as the wave of the amplitude signal of a CRT. The function of the wave in FIG. 15 can be presented by equation (1).

$$D(f) = \begin{cases} a & f < f_c \\ \text{any_function} & f_c < f \end{cases} \tag{1}$$

wherein D(f) is the pre-determined function of the amplitude signal 331, $f$ is the display frequency of display system; $f_c$ is the cutoff frequency 333 of display system; a is the signal value 335 of the amplitude signal 331; and the any_function is any function 337. When the display frequency is smaller than the cutoff frequency 333, the D(f) is the signal value 335. When the cutoff frequency 333 is smaller than the display frequency, the D(f) is any function 337. According to FIG. 15, the pre-determined function, D(f) is a zero order function. The zero order function is a horizontal wave distribution when the display frequency is smaller than the cutoff frequency. The horizontal wave distribution is based on the digits the signal process.

Figure 16:
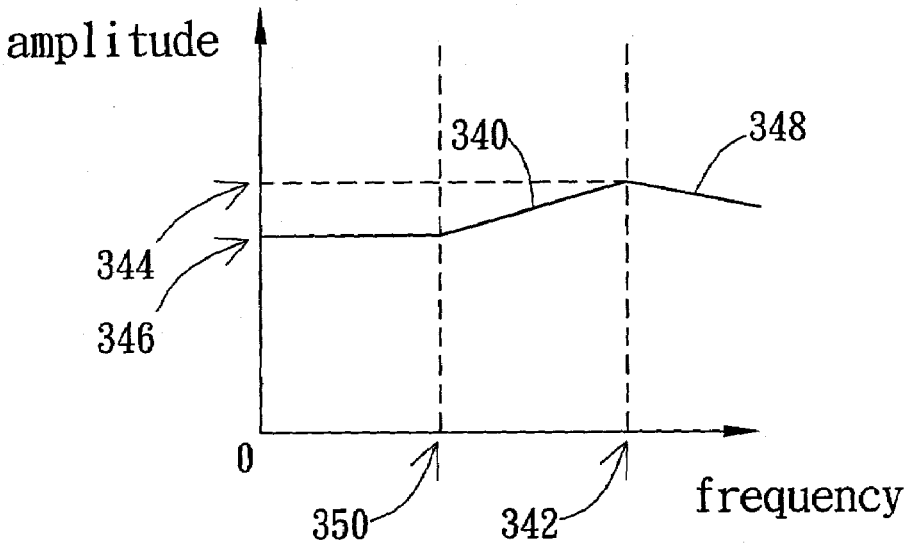
FIG. 16 is a spectrum diagram showing the brightness signal processed by Fourier Transformation by utilizing another embodiment of the present invention in the driving technique of LCD.

Referring to FIG. 16, FIG. 16 is a spectrum diagram showing the brightness signal processed by Fourier Transformation by utilizing another embodiment of the present invention in the driving technique of LCD. By utilizing another embodiment of the present invention, after the brightness signal is processed by Fourier Transformation, the wave of the amplitude signal 340 will be shown as FIG. 16. The function of the wave shown in FIG. 16 can be presented by equation (2), $$D(f) = \begin{cases} a & f < f_c \\ a + \dfrac{(f - f_c/2)}{f_c} \times 2 \times b & \dfrac{f_c}{2} < f < f_c \\ \text{any_function} & f_c < f \end{cases} \tag{2}$$

wherein D(f) is the default function of the amplitude signal 340; $f$ is the display frequency of display system; $f_c$ is the cutoff frequency 342 of display system, and the frequency 350 is half of the cutoff frequency 342; a is the signal value 344 of the amplitude signal 340; b is the other signal value 346 of the amplitude signal 340; and the any_function is any function 348. When the display frequency is smaller than the cutoff frequency 342, the D(*f*) is the signal value 344. When the display frequency is between the *f* and the $$\frac{f_c}{2},$$

D(*f*) is the first function $$a+\frac{-f_c-}{f_c}\times 2\times b.$$

When the cutoff frequency 342 is smaller than the display frequency, the D(*f*) is any function 348. According to the FIG. 16, the pre-determined function, D(*f*),is a first order function. The first order function is a first wave that is rising gradually when the display frequency is smaller than the cutoff frequency. The first wave is based on the digital signal process.

Figure 17:
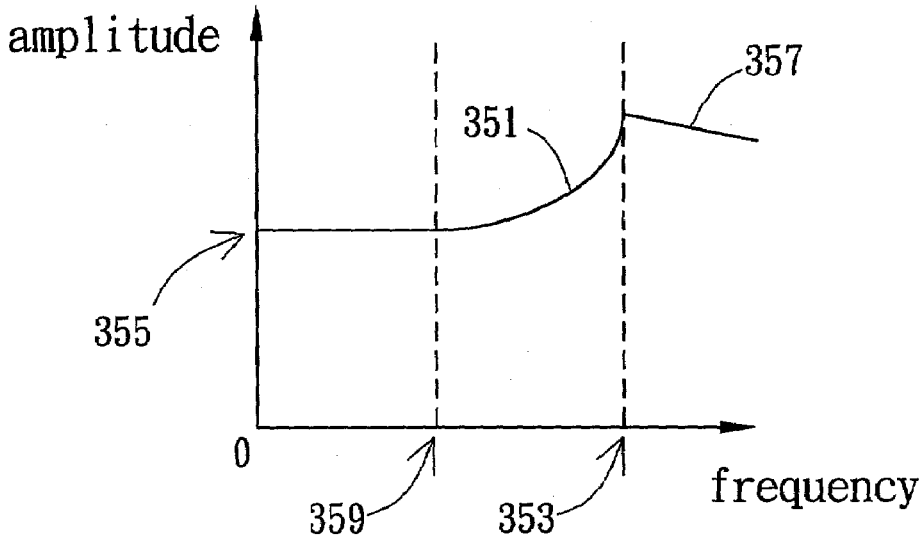
FIG. 17 is a spectrum diagram showing the brightness signal processed by Fourier Transformation by utilizing another embodiment of the present invention in the driving technique of LCD.

Referring to FIG. 17, FIG. 17 is a spectrum diagram showing the brightness signal processed by Fourier Transformation by utilizing another embodiment of the present invention in the driving technique of LCD. By utilizing another embodiment of the present invention, after the brightness signal is processed by Fourier Transformation, the wave of the amplitude signal 351 will be shown as FIG. 17. The function of the wave shown in FIG. 17 can be presented by equation (3), $$D(f)=\begin{cases} a & f<f_c \\ a+c\times\left(f-\frac{f_c}{2}\right)^2 & \frac{f_c}{2}<f<f_c \\ \text{any_function} & f_c<f \end{cases} \tag{3}$$

wherein D(*f*) is the default function of the amplitude signal 351; *f* is the display frequency of display system; $f_c$ is the cutoff frequency 353 of display system, and the frequency 359 is half of the cutoff frequency 353; a is the signal value 355 of the amplitude signal 351; c is a constant; and the any_function is any function 357. When the display frequency is smaller than the cutoff frequency 353, the D(*f*) is the signal value 355. When the display frequency is between the *f* and the $$\frac{f_c}{2},$$

D(*f*) is the second function $$a+c\times\left(f-\frac{f_c}{2}\right)^2.$$

When the cutoff frequency 355 is smaller than the display frequency, the D(*f*) is any function 357. According to the figure 17, the pre-determined function, D(*f*), is a second order function. The second order function is a second wave that is rising gradually when the display frequency is smaller than the cutoff frequency. The second wave is based on the digital signal process.

Moreover, in FIG. 11, the digital signal process module 250 and the compiler module 260 of the present invention are not limited within the same module, and the function of the digital signal process module 250 and the compiler module 260 can be implemented by software, firmware or hardware, thereby matching the display system flexibly. In addition, the setting of firmware can be adjusted properly to match different operational surrounding for optimization if the present invention is implemented by firmware.

The parameters calculated by the digital signal process module 250 comprise: ampliative multiple, temperature, visible angle, clock, frequency and work voltage, etc. These parameters are collected from the display system, so that the digital signal process module 250 will be adjusted by the parameters from the display system in order to obtain the image quality that is optimization for eyes. For example, in dynamic display, the fast and clear display is required, because human eyes will trace the moving object habitually, so that the display signal will be compensated for the improvement of the dynamic display quality by utilizing the present invention. In static image display, human eyes are sensitive to the brightness, contrast, gray level, etc, so that the display speed is not rather important by comparison. Likewise, by utilizing the present invention, the static image will be compensated properly to achieve the optimization for human eyes.

The advantage of the present invention is to utilize a digital signal process, such as an operating process of inverse function, to handle the display signal, wherein the digital signal process is performed by utilizing the digital signal process module provided by the present invention in driving technique of hold-type display in order to obtain the compensative signal of the display signal. Then, a compiling process is performed with the display signal and the compensative signal for improvement of quality of the display signal. By utilizing the method provided by the present invention, the response time of liquid crystal of LCD will be speeded up, and the display quality will be improved, especially in high frequency, so that the dynamic display character of hold-type display will be enhanced.

Another advantage of the present invention is the inverse function process of the digital signal process module provided by the present invention is performed according to the data collected from the display system, so that the proper dynamic compensation for the display signal can be obtained. Therefore, both dynamic and static displays will present the image with high quality, thereby achieving the optimization for human eyes. Moreover, the present invention can be implemented with low cost and does not need to change the original display system a lot.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A method for handling a signal, applied to a hold-type display, the method comprising:

providing an input signal;

pre-processing the input signal;

providing a signal process module, wherein the signal process module includes a digital signal process module;

collecting system and operational surrounding parameters utilizing said digital signal process module;

determining an inverse function of the pre-processed input signal;

determining a compensative signal of the input signal based on said inverse function and said system and operational surrounding parameters; and performing a compiling process with the compensative signal and the pre-processed input signal thereby outputting an output signal, wherein the output signal comprises the pre-processed input signal when a display frequency is below a first frequency and has a pre-determined function when said display frequency is above said first frequency.

2. The method of handling a signal according to claim 1, wherein the input signal is valid wave.

3. The method of handling a signal according to claim 1, wherein the signal process module is selected from a group consisting of software, firmware and hardware.

4. The method of handling a signal according to claim 1, wherein the compiling process is performed by a module selected from a group consisting of software, firmware and hardware.

5. The method of handling a signal according to claim 1, wherein the pre-determined function is a zero order function.

6. The method of handling a signal according to claim 5, wherein the zero order function is a horizontal wave distribution, and the horizontal wave distribution is based on the digital signal process within the frequency band.

7. The method of handling a signal according to claim 1, wherein the pre-determined function is a first order function.

8. The method of handling a signal according to claim 7, wherein the first order function is a first wave that is rising gradually, and the first wave is based on the digital signal process within the frequency band.

9. The method of handling a signal according to claim 1, wherein the pre-determined function is a second order function.

10. The method of handling a signal according to claim 9, wherein the second order function is a second wave that is rising gradually, and the second wave is based on the digital signal process within the frequency band.

11. A method for handling a display signal of an LCD, the method comprising:

providing an input signal;

pro-processing the input signal;

providing a display signal process and drive module, wherein the display signal process and drive module includes a digital signal process module;

collecting system and operational surrounding parameters utilizing said digital signal process module;

determining an inverse function of the pre-processed input signal;

determining a compensative signal of the input signal based on said inverse function and said system and operational surrounding parameters; and performing a compiling process with the compensative signal and the pre-processed input signal thereby outputting an out signal, wherein the output signal comprises the pre-processed input signal when a display frequency is below a first frequency and has a pre-determined function when the display frequency is above the first frequency.

12. The method for handling a display signal of an LCD according to claim 11, wherein the input signal is valid wave.

13. The method for handling a display signal of an LCD according to claim 11, wherein the display signal process and drive module is selected from a group consisting of software, firmware and hardware.

14. The method of handling a display signal of an LCD according to claim 11, wherein the compiling process is performed by a module selected from a group consisting of software, firmware and hardware.

15. The method of handling a display signal of an LCD according to claim 11, wherein the pre-determined function is a zero order function.

16. The method of handling a display signal of an LCD according to claim 15, wherein the zero order function is a horizontal wave, and the horizontal wave distribution is based on the digital signal process within the frequency band.

17. The method of handling a display signal of an LCD according to claim 11, wherein the pre-determined function is a first order function.

18. The method of handling a display signal of an LCD according to claim 17, wherein the first order function is a first wave that is rising gradually, and the first wave is based on the digital signal process within the frequency band.

19. The method of handling a display signal of an LCD according to claim 11, wherein the pre-determined function is a second order function.

20. The method of handling a display signal of an LCD according to claim 19, wherein the second order function is a second wave that is rising gradually, and the second wave is based on the digital signal process within the frequency band.

21. A method for handling a display signal of an LCD, comprising:

providing an input signal;

pre-processing the input signal;

providing a display signal process and drive module, wherein the display signal process and drive module include a digital signal process module;

collecting system and operational surrounding parameters utilizing said digital signal process module, the parameters being selected from the group consisting of ambient temperature, system operating temperature, visual angle, clock time, frequency and work voltage;

determining an inverse function of the pre-processed input signal;

determining a compensative signal of the input signal based on said inverse function and said system and operational surrounding parameters; and performing a compiling process with the compensative signal and the input signal thereby outputting an output signal, wherein the output signal comprises the pre-processed input signal when a display frequency is below a first frequency and has a pre-determined function when said display frequency is above said first frequency.

22. The method of claim 21, wherein said first frequency comprises a cutoff frequency of the LCD.

* * * * *